BEST AVAILABLE COPY

United States Patent [19]

DeLigt

[11] Patent Number: 4,470,224

[45] Date of Patent: Sep. 11, 1984

[54] VENEER FINISHING MACHINE

[75] Inventor: John DeLigt, Covington, Va.

[73] Assignee: Westvaco Corporation, New York, N.Y.

[21] Appl. No.: 403,160

[22] Filed: Jul. 29, 1982

[51] Int. Cl.[3] ..... B24B 21/04

[52] U.S. Cl. ..... 51/138; 51/147

[58] Field of Search ..... 51/76 R, 138, 139, 74 R, 51/78, 168, 169, 99, 147; 83/809, 810, 811, 812; 414/4, 5

[56] References Cited

U.S. PATENT DOCUMENTS

| | | | |
|---|---|---|---|
| 2,003,905 | 6/1935 | Schottland et al. | 51/76 R |
| 2,282,252 | 5/1942 | Scott et al. | 51/215 H |
| 2,861,700 | 11/1958 | James | 414/4 |
| 2,958,163 | 11/1960 | Cammerzell, Jr. | 51/76 |
| 3,178,860 | 4/1965 | Clyne | 51/76 |
| 3,208,187 | 9/1965 | Ernst | 51/76 |
| 3,611,643 | 10/1968 | Crane et al. | 51/76 |

*Primary Examiner*—Frederick R. Schmidt
*Assistant Examiner*—Matthew D. Daschel
*Attorney, Agent, or Firm*—W. A. Marcontell; R. L. Schmalz

[57] ABSTRACT

A machine for surface finishing wood veneer feeds the veneer to a grinding drum positioned over a rigid bed plate. A continuous loop feed belt carries the veneer to and away from the bed plate but passes thereunder to permit a rigid gap between the bed plate and the drum grinding surface. The drum is carried on a swing arm that is independently driven about an arc between a working position and a retracted, repair position.

5 Claims, 5 Drawing Figures

VENEER FINISHING MACHINE

BACKGROUND OF THE INVENTION

1. Field Of The Invention

The present invention relates to the art of material surface finishing by grinding. More particularly, the present invention relates to machinery for finishing the surface of extremely thin strips of wood veneer.

2. Description Of The Prior Art

The objective of wood veneering includes the lamination of a thin slice of expensive, furniture grade wood to the face of a structural substrate to obtain the esthetic, grain and texture surface qualities of the expensive wood. Such veneer slices may be as thin as 0.025 inch, in random widths up to 24 inches and in random lengths up to 10 feet.

A 0.025 inch thickness strip of natural wood has very little structural rigidity perpendicular to the surface planes against which any finishing forces are to be applied. Additionally, a 0.025 inch thickness provides a very small margin of error by power tools having no "feel" for how much material is being removed from a single location during the finishing process.

Accordingly, the gap between the cutting edge of the finishing tool and a rigid support surface for the flimsy material within that gap must be precisely controlled to prevent variations in the final veneer thickness.

Also necessary to a uniform surface finish of natural veneer strip is a uniform feed rate to the finish cutting tool so that each increment of the surface is subjected to the same degree of tool working as all other increments.

Driven belt fed surface finishing machines such as represented by U.S. Pat. No. 3,178,860 to J. N. Clyne and U.S. Pat. No. 2,958,163 to F. E. Gammerzell, Jr. are well known to the prior art. The operative principle of such prior art machines is to continue the material carrying feed belt between a supporting bed surface and the cutting tool. Any compliance within the flexible feed belt or between the belt and the support surface therefore is reflected in a variance between the finishing tool and the worked material surface.

It is, therefore, an object of the present invention to provide a continuous belt fed veneer finishing machine having a precisely controllable gap setting between the machine cutting tool and a rigid bed surface.

Another object of the present invention is to provide a drum grinding finishing machine wherein the drum tool may be quickly withdrawn from the bed plate to expedite abrasive replacement.

Another object of the present invention is to provide a precisely adjustable abutment surface for a veneer surface grinding drum to regulate the depth of grinding cut within 0.001 inch.

Another object of the present invention is to provide a replaceable, flexible strip abrasive surface for a grinding drum having no transverse irregularities to the cylindrical continuity of the drum.

SUMMARY

These and other objects of the present invention are accomplished by a drum grinding tool wherein the abrasive surface is provided by narrow width, abrasive coated belting wrapped helically about the drum surface and secured at respective ends.

The drum is axle mounted between two swing arms secured to a frame axle that is parallel to the drum axle. The frame axle is secured to the machine frame by bearing mounts. A reversible motor and reduction gear drive train rotates the grinding tool between an operating position and an arcuately retracted position which facilitates the abrasive belt wrapping procedure. In the operational position, hard-faced pads respective to each swing arm engage respective frame mounted abutment surfaces that are positionally adjustable for setting the appropriate cutting depth of the tool.

The swing arm drive train includes a self-locking worm drive that maintains a tensile stress on the drive components to sustain an engagement pressure of the swing arm pads against the adjustable abutment surfaces.

The drum is rotatively driven by an independent motor that is mounted coaxially with the frame axle. A belt drive between a driving sheave on the motor and a driven sheave on the drum axle remains in continuous tensile engagement throughout the displacement arc of the grinding drum.

For feeding the veneer material to the abrasive drum surface, a continuous conveyor belt is provided to circuit the machine frame with table runs along the infeed and outfeed sides of the abrasive drum. Directly under the abrasive drum, however, the material feed belt is directed under a rigid bed plate so that the belt loop does not course between the bed plate and the material. Consequently, the veneer material is forced by the thrust and pull of the conveyor belt to slide over the rigid bed plate. This arrangement provides a precisely controllable fixed distance between the cylindrical abrading surface of the drum and the rigid bed plate to produce a surface finished veneer strip of unusually uniform thickness.

BRIEF DESCRIPTION OF THE DRAWINGS

Relative to the drawings wherein like reference characters designate like or similar elements throughout the several figures.

DESCRIPTION OF THE PREFERRED EMBODIMENT

Figure 1:
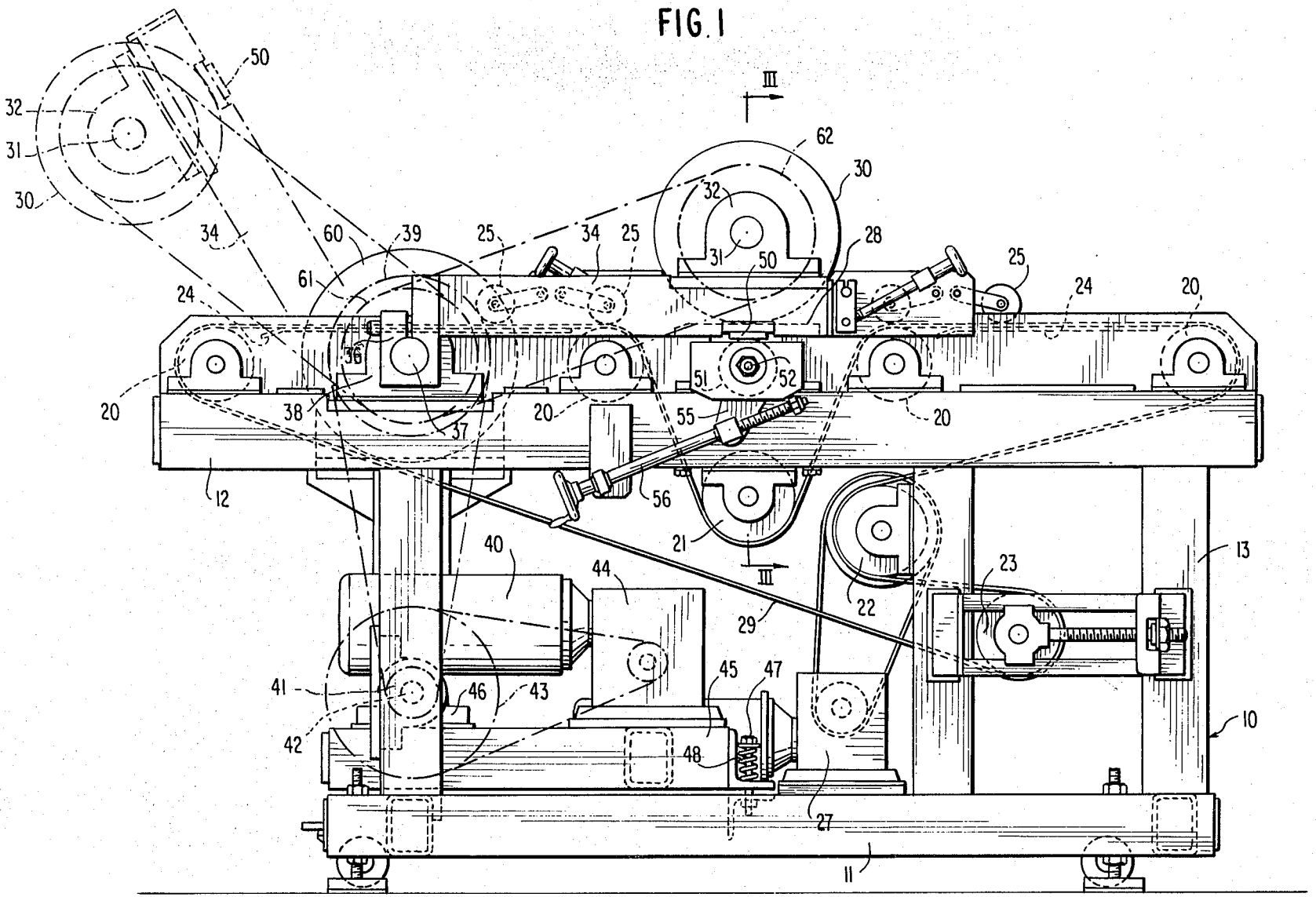
FIG. 1 is a side elevational view of the present invention.
Figure 2:
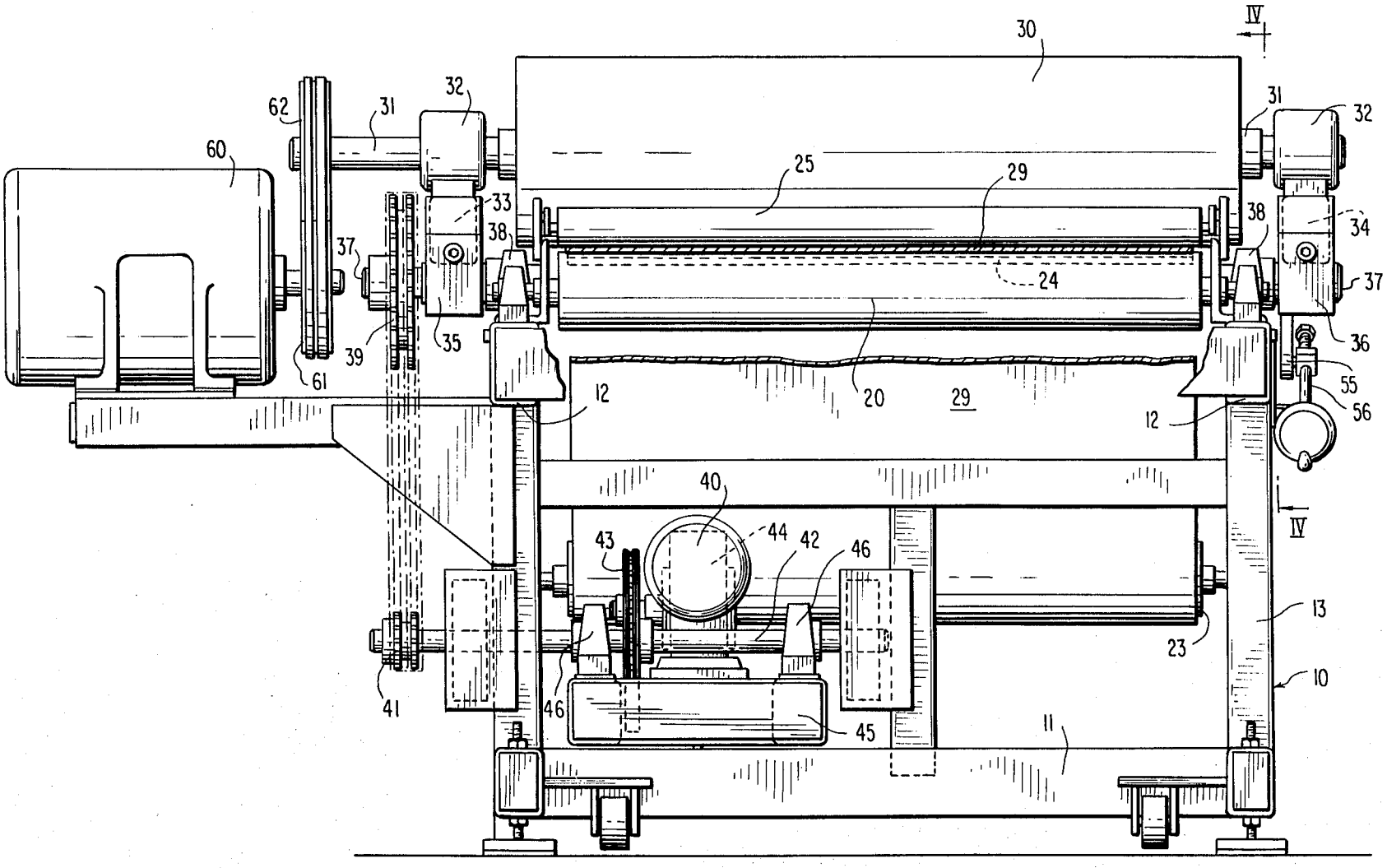
FIG. 2 is an end elevational view of the present invention.

Relative to FIGS. 1 and 2 of the drawing, the dynamic components of the present invention are supported by a tubular steel space frame 10 having horizontal base rails 11 and table rails 12 separated by vertical columns 13.

Spanning transversely between the two longitudinal table rails 12 are four crowned table rolls 20 carrying a material feed belt 29. Between the two interior table rolls 20 set below the table plane is an idler roll 21 for supporting the traveling circuit of the feed belt 29 below the rigid bed plate 28. To complete the feed belt loop, the belt circuit is wrapped about a drive roll 22 and a tension roll 23. Rotational power is delivered to the drive roll 22 by means of a motor driven chain transmission 27.

Also spanning the table rails 12 between respective in-feed and out-feed sets of table rolls 20 are table plates 24 for supporting the horizontal run of the feed belt 29 between table rolls 20.

Against the upper surface of the feed belt 29 are provided a set of pressure rollers 25 on both, the in-feed and out-feed side of the bed plate 28 for the purpose of securing the worked veneer strips to the feed belt as the veneer surface is abraded by the grinding drum 30. Further to the same purpose are hold-down blades 26 bearing against the bed plate 28 with an adjustable tension mechanism.

The grinding drum 30 is non-rotatively secured to a carrier axle 31 which is mounted by pillow block bearings 32 to swing arms 33 and 34. The pivot base ends of swing arms 33 and 34 are non-rotatively secured to a drive axle 37 by means of off-set clamping blocks 35 and 36. The drive axle 37 is rotatively mounted to the table rails 12 by pillow block bearings 38.

On the drive side of the machine (FIG. 2) it is seen that drive axle 37 projects beyond the respective table rail 12 to non-rotatively receive a chain driven sprocket 39. The corresponding drive sprocket 41 is secured to a bearing mounted jackshaft 42. The jackshaft is driven by the large sprocket 43 of an intermediate reduction transmission. Primary speed reduction from the swing arm drive motor 40 is derived from a worm reduction unit 44. Sub-frame 45 to which the reversible motor 40 and reduction unit 44 are secured is pivotally secured to the jackshaft 42 by bearing blocks 46. A spring loaded tether bolt 47 limits the angular arc the sub-frame 45 is allowed to make about the jackshaft 42 due to a torque transmitted through the swing arm drive system that exceeds the hold down tension of the tether bolt spring 48.

Figure 3:
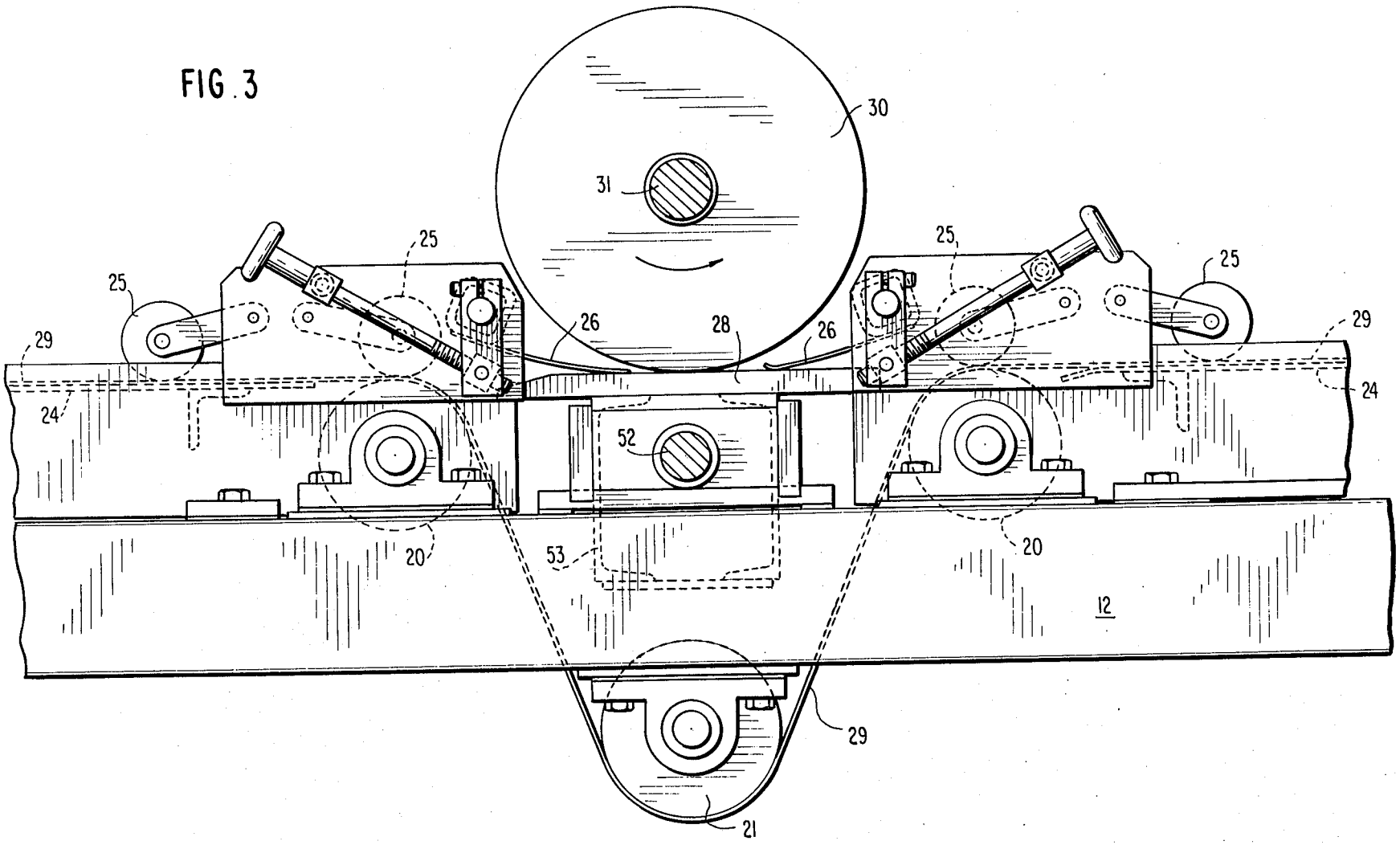
FIG. 3 is a sectional view of the invention taken along cut line III—III of FIG. 1.
Figure 4:
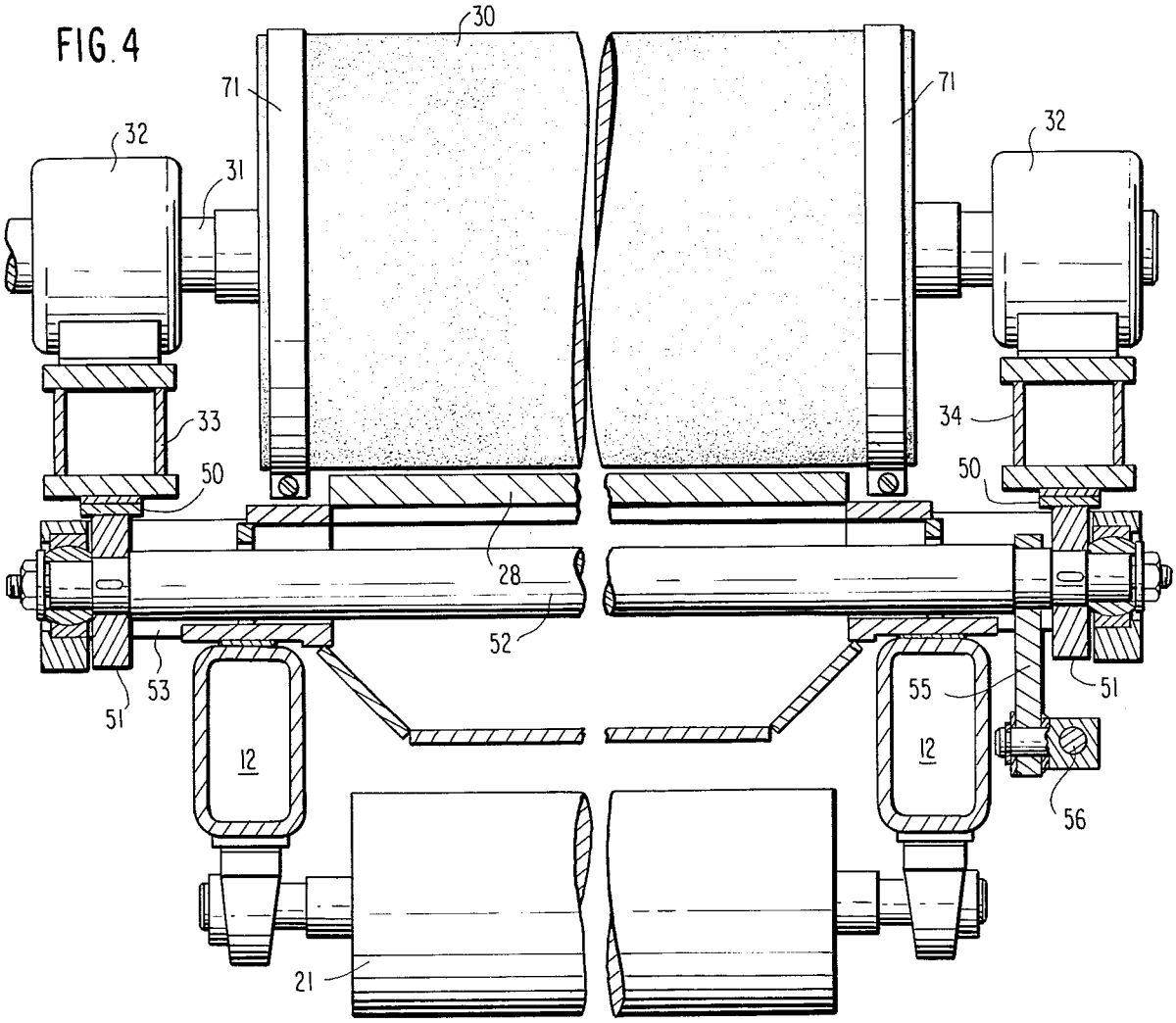
FIG. 4 is a sectional view of the invention taken along cut line IV—IV of FIG. 2; and, FIG. 5 is an isolated isometric view of the grinding drum illustrating the disposable abrasive surface application technique.

At the distal ends of swing arms 33 and 34 beneath the pillow blocks 32 for supporting the grinding drum carrier axle 31 are provided hardfaced pads 50 for contact engagement with the peripherial surfaces of eccentrics 51. See FIGS. 3 and 4. These eccentrics 51 are linked together by a cross-shaft 52 which is bearing mounted for rotation within outrigger extensions of a cross-beam 53 secured to the table rails 12. Crank arm 55, non-rotatively secured to the cross-shaft 52, is adjustably rotated by a screw-shaft 56 and hand wheel for adjusting the angular orientation of the cross-shaft and eccentrics 51 about the cross-shaft rotational axis. Such rotation of the eccentrics 51 about the cross-shaft axis will adjust the separation distance between the grinding drum 30 periphery and rigid bed plate 28.

Rotary power to the grinding drum 30 is derived from the motor 60 set in coaxial alignment with the axis of the swing arm drive axle 37 so that the radial separation distance between the motor driven belt sheave 61 and the grinding drum sheave 62 remains constant throughout the operative arc of the swing arms 33 and 34.

Figure 5:
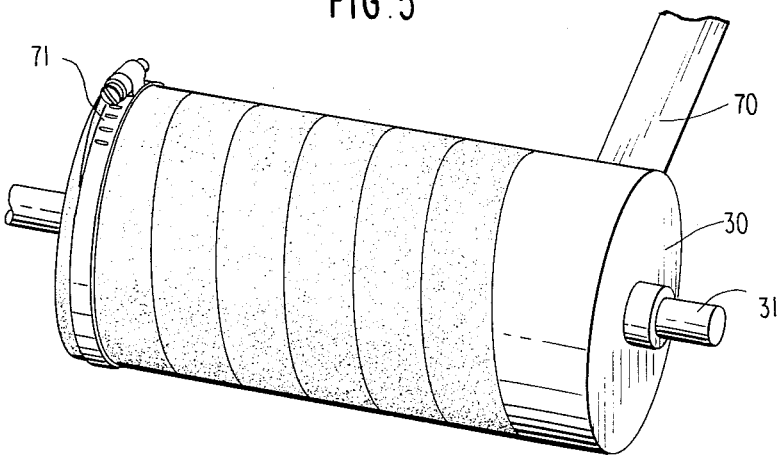

The grinding drum 30 abrasive surface is helically wrapped thereabout, as illustrated by FIG. 5, from narrow width, abrasive surface belting 70. Such width should be no greater than half the axial length of the drum 30 to provide at least one full period of helix about the drum surface. By providing a drum length, greater than the maximum veneer width to be worked thereby, such as single-lead helix wrap of abrasive belting may be end-secured by means of flexible worm clamps 71. By such technique, the grinding surface is uniformly continuous within the working segment of the drum length. Abrupt, transverse discontinuities as result from cleated ends of a disposable abrasive surface are avoided.

From the afore described grinding drum 30 mount and swing arm drive mechanism it will be seen that the swing arms 33 and 34 may be driven by the motor 40 and speed reduction transmission to an arcuate position shown by FIG. 1 in phantom lines where the drum 30 is removed from proximity of the bed plate 28 and other associated structure to simplify and expedite replacement of the disposable abrasive surface 70 as represented by FIG. 5.

Reversible motor 40 returns the swing arms 33 and 34 and grinding drum 30 to the operative position whereat hardened pads 50 engage the eccentrics 51. As the swing arm drive pulls the arms 33 and 34 against the eccentrics 51, counteractive torque about the jackshaft 42 pulls the sub-frame 45 against the tether spring 48. The desired working load between the swing arm pads 50 and the eccentrics 51 is achieved by a statically balanced condition between the torque load about jackshaft 42 imposed by the motor 40, worm reduction drive 44, and sub-frame 45 weight relative to the counter torque of the transmission drive links which is statically sustained by the self-locking worm of the reduction drive 44 in a de-energized condition of the motor 40.

In brief, it is the weight of the swing arm motor 40 and drive components that hold the swing arms firmly biased against the eccentrics 51. Simultaneously, the drum is structurally free to lift from the operating position in the event that debris, scrap metal etc. should be drawn into the nip between the drum 30 and the veneer surface: a circumstance that could destroy the machine if these components were secured together rigidly such as by structural clamping means.

In addition, due to the absence of clamps or other structural securing devices the operator is freed of the burden to disengage such clamps prior to retraction of the drum 30 for abrasive surface replacement.

Depth of cut by the drum 30 into a veneer strip surface is set by the operator by rotation of the hand wheel and screw shaft 56 which rotates the eccentrics 51 about the cross-shaft 52 axis. Retraction of the drum 30 from the operative position does not disturb the depth-of-cut setting.

It should be further noted that the operating side swing arm 34 is angularly set about the axis of carrier axle 31 at a slightly more advanced position than the power side swing arm 33 to torsionally prestress the carrier axle 31 when both hardened pads 50 initially engage the eccentrics 51. As the swing arm drive loads the end-mounted chain sprocket 39 with induced torque, uniform loading will be transmitted to the eccentrics 51.

Having fully described my invention, obvious modifications and mechanical equivalents will readily occur to those of ordinary skill in the art.

As my invention, however, I claim:

1. A rotary machine tool for material surface finishing comprising:

swing arm means having one end secured to machine frame structure for rotation about a first horizontal axis, the other end of said swing arm means supporting a second horizontal axis substantially parallel to said first axis about which a material surface working tool is rotatively driven;

frame abutment means for supporting said swing arm means at a tool operating end position of a swing arm rotational arc about said first axis;

first chain sprocket means secured to said swing arm means for driving said swing arm means about said rotational arc, said first sprocket means being linked to second sprocket means mounted on jackshaft means;

subframe means for mounting first drive motor means, said subframe means and first drive motor means being pivotally secured for rotation about an axis of said jackshaft means, said first drive motor means being linked to said second sprocket means whereby the weight of said subframe means and first drive motor means biases said swing arm means against said frame abutment means;

closed circuit feed belt means for carriage of worked material along a table surface of said frame structure into and away from said working tool; and, bed plate means secured to said frame means substantially coplanar with said table surface proximate of said tool operating end position, said bed plate means being disposed between said tool at said operating end position and the circuit of said feed belt.

2. A rotary machine tool as described by claim 1 comprising second drive motor means for said working tool secured for drive rotation about an axis coaxial with said first axis.

3. A rotary machine tool as described by claim 1 wherein said frame abutment means is adjustable to vary the proximity of said working tool with said bed plate means.

4. A rotary machine tool as described by claim 3 wherein said first drive motor means comprises a self-locking worm drive to maintain said bias of said swing arm means against said frame abutment means without energization of said drive motor means.

5. A rotary machine tool as described by claim 1 wherein said swing arm means comprises two swing arm elements spacially separated along and non-rotatively secured to an axle element that is rotatively disposed coaxially of said first axis, said first sprocket means being secured to said axle element more proximate of one swing arm element than the other and said two swing arm elements being angularly displaced on said axle about said first axis to equalize the moment load on said frame abutment means when said swing arm elements are in said tool operating end position.

* * * * *